United States Patent [19]

Fröhlich

[11] Patent Number: 4,704,781

[45] Date of Patent: Nov. 10, 1987

[54] PROCESS AND APPARATUS FOR MOUNTING A SLIDE FASTENER NEAR OPPOSING EDGES OF TWO PIECES OF MATERIAL

[75] Inventor: Alfons Fröhlich, Essen, Fed. Rep. of Germany

[73] Assignee: Opti Patent- Forschungs-und Fabrikations-AG, Riedern-Allmeind, Switzerland

[21] Appl. No.: 892,701

[22] Filed: Jul. 31, 1986

[30] Foreign Application Priority Data

Aug. 3, 1985 [DE] Fed. Rep. of Germany ..... 3527894
Aug. 3, 1985 [DE] Fed. Rep. of Germany ..... 3527895

[51] Int. Cl.[4] ..... B21D 53/50; A41H 37/06; D05B 3/12; D05B 29/00

[52] U.S. Cl. ..... 29/408; 29/33.2; 112/265.1; 112/265.2; 112/235

[58] Field of Search ..... 112/265.1, 265.2, 152, 112/153, 255, 163; 29/408–410, 33.2, 766–770

[56] References Cited

U.S. PATENT DOCUMENTS

| | | | |
|---|---|---|---|
| 3,511,199 | 5/1970 | Howell | 112/235 |
| 3,646,899 | 3/1972 | Reynolds et al. | 112/235 |
| 3,680,510 | 8/1972 | Ebata | 112/235 |
| 3,735,718 | 5/1973 | Vizgirda et al. | 112/235 |
| 3,859,939 | 1/1975 | Howell | 112/235 |
| 3,993,009 | 11/1976 | Osaki | 112/235 |
| 4,069,780 | 1/1978 | Minami | 112/235 |
| 4,159,001 | 6/1979 | Doori | 112/235 |

*Primary Examiner*—P. W. Echols
*Assistant Examiner*—Steven Nichols
*Attorney, Agent, or Firm*—Karl F. Ross; Herbert Dubno

[57] ABSTRACT

In the process for mounting a slide fastener segment or slide fastener near the opposing edges of two pieces of material, particularly on a slit in a piece of clothing, a slide fastener strip, the slide fastener segment or the slide fastener and the pieces of material are fed to the sewing stations of a two needle sewing machine. The pieces of material in the region between the sewing stations are positioned to form a gap and are curved so that a portion of each hangs substantially vertically from two fold edges or creases in an intervening space between both of the sewing stations. Both slide fastener halves of the open slide fastener segment or the open slide fastener are sewn on from above on the horizontal portion of the pieces of the material along the fold edges. Apparatuses for performing the process according to my invention are also described.

12 Claims, 16 Drawing Figures

PROCESS AND APPARATUS FOR MOUNTING A SLIDE FASTENER NEAR OPPOSING EDGES OF TWO PIECES OF MATERIAL

FIELD OF THE INVENTION

My present invention relates to a process for mounting a slide fastener near the opposing edges of two pieces of material and, more particularly, to a process for mounting a slide fastener from two slide fastener halves cut from a continuously fed slide fastener strip near the opposing edges of two pieces of material. Of course the pieces of material can be assembled from several individual pieces or can be essentially continuous. They can be cut later to size for use in various articles of clothing. My invention also relates to an apparatus for carrying out this process.

BACKGROUND OF THE INVENTION

One embodiment of my invention is concerned with a process for mounting a slide fastener comprising two slide fastener halves cut from a continuously fed slide fastener strip and for pulling up a slider in the sewn in slide fastener. More specifically that process comprises feeding the sliderless slide fastener strip and the pieces of material jointly and simultaneously to the sewing station of a two needle sewing machine, cutting away the sewn in slide fastener after the sewing operation and pulling up the slide fastener slider with a handle projecting downwardly from it toward the upper side of the pieces of material.

OBJECTS OF THE INVENTION

It is an object of my invention to provide an improved process and apparatus for mounting a slide fastener near opposing edges of two pieces of material, particularly mounting a slide fastener comprising two slide fastener halves cut from a continuously fed slide fastener strip.

It is also an object of my invention to provide an improved process for mounting a slide fastener near opposing edges of two pieces of material so that the seams of the sewn in slide fastener cannot be seen from the top side of the pieces of material.

It is a further object of my invention to provide an apparatus to perform the process according to my invention.

SUMMARY OF THE INVENTION

These objects and others which will become more apparent hereinafter are attained in a process and apparatus for mounting a slide fastener or slide fastener segment near the opposing edges of two pieces of material, particularly on a slit in a piece of clothing. This slide fastener or slide fastener segment is fed continuously to the sewing stations of a two needle sewing machine.

According to my invention the pieces of material in the region between both sewing stations define a gap, form fold edges or creases and are curved so that a portion of each hangs substantially vertically in an intervening compartment between both sewing stations. A slide fastener strip is fed in the open state to the sewing stations. Both slide fastener halves with their supporting pieces are sewn on the horizontal portions of the pieces of material adjacent the respective creases.

The handle of the slide fastener slider pulled up later can hang downwardly under the gap. Then the sewn in slide fastener is separated to form a leading end and a trailing end by cutting the slide fastener strip. The leading end of the slide fastener strip is fed into a slide fastener slider held fixed in place and the opposing rows of slide fastener elements are coupled together. After that the slide fastener slider is released and during this operation the sewing operation continues upstream of or behind the trailing end. The portions of the pieces of material not attached to the supporting pieces of the slide fastener hanging into the intervening space are bent back to form folded edges into a plane parallel to the plane of the slide fastener. The coupled slide fastener strip halves can be provided with an end piece near the leading end.

The process according to my invention can be so conducted that the rows of opposing slide fastener elements are positioned free between the fold edges. My invention teaches that the entire portion of the pieces of material hanging in the intervening space are placed substantially in a plane parallel to the plane of the slide fastener. The slide fastener can also be worked in so that the opposing rows of slide fastener elements are covered in the worked in state. My invention additionally teaches that the slide fastener strip halves are applied with supporting strips folded along the fold edges or creases directed along the slide fastener longitudinal direction covering the rows of slide fastener elements so that the rows of slide fastener elements with the attached supporting strips or tapes are pivoted into the gap in the sewing operation and the seams are positioned near the fold edges or creases of the supporting strips.

Advantageously in the process according to my invention a slide fastener strip can be sewn in along the edges of two pieces of material to form a slide fastener and of course with the seams covered and if necessary with the opposing rows of slide fastener elements, for example slide fastener teeth, also covered. Moreover the slide fastener slider can be pulled up. Of particular advantage is the fact that the process can be performed with a very simple apparatus.

One apparatus for performing the above described process according to my invention comprises a double needle sewing machine having upper thread sewing mechanisms, lower thread sewing mechanisms, feed mechanisms for the upper piece of material and feed mechanisms for the bottom piece of material. The sewing mechanisms and the feed mechanisms have mechanically or electrically coupled drives. Furthermore the lower thread sewing mechanisms are separately positioned about an intervening space.

The apparatus for performing the process according to my invention has a slide fastener guide device belonging to the upper thread sewing mechanisms bridging the intervening space which is positioned opposite the separate lower thread sewing mechanisms. This slide fastener guide device fastens the rows of slide fastener elements of the sewn in open slide fastener strip halves and a receiving space is positioned under the intervening space for the pieces of material.

One other embodiment of my invention concerns a process for mounting a slide fastener equipped with supporting tapes which is already provided with a slider and a slider handle, a beginning piece and an opposing end piece by covered or concealed seams near the opposing edges of two pieces of material, particularly on the slit of an article of clothing. In this process the slider of the slide fastener is moved to the open position and both support tapes of the open slide fastener are placed on the edges of the associated pieces of material. The seams are made from the beginning piece to the slider of the open slide fastener simultaneously by a many needle sewing machine. Furthermore the seams are covered by forming fold edges or creases by folding the pieces of material to contact themselves so that the slider is positioned between the fold edges or creases.

My process is conducted so that the mounting of the slide fastener is practically completed with the sewing operation. Expensive manual work is no longer required and particularly can be abandoned in the above described pulling through of the end of the slide fastener by the already sewn on open slide fastener. A particularly suitable apparatus for performing the process according to my invention has been described.

According to my invention further the pieces of material in the region between the seams forming the gap are curved so that a portion of each hangs substantially vertically. The fold free slide fastener with its smooth support tapes is sewn on in the uncurved horizontal region of the pieces of material so that the handle of the slider is directed downwardly below the gap. After that the portions of the pieces of material not attached with the support tapes hanging into the gap are put substantially in a plane parallel to the plane of the slide fastener. So that the rows of slide fastener elements should lie free between the fold edges or creases in the worked in state, the invention teaches that the entire portion of the pieces of material projecting into the gap in the sewing operation is folded into the plane parallel to the plane of the slide fastener. This folding occurs along the seams. Also the rows of slide fastener elements of the slide fastener should be covered by the strips of material in the worked in state so that a slide fastener with support tapes folded along a fold edge directed along the slide fastener longitudinal direction covering the rows of slide fastener elements is used and the rows of opposing slide fastener elements with the support tapes attached are swung around in the sewing operation into the gap and the seams are positioned near the fold edges or creases of the support tapes.

In the process according to my invention expensive manual work is no longer required. The process can be performed automatically without difficulty. When the sewing operation is finished the entire mounting process is practically complete since the folding or placing of the portions of the pieces of material hanging into the gap can occur automatically without further substantial effort. Of particular advantage is the fact that the described process can be effected without especially large expense using known sewing machine technology.

My process is advantageously performed by a double needle sewing machine. The sewing machine has a slide fastener guide device belonging to the upper thread sewing mechanisms bridging the gap positioned opposing the separate lower thread sewing mechanisms. This slide fastener guide device fastens together the row of slide fastener elements of the sewn in open slide fastener. A receiving space for the pieces of material is positioned under the gap. The slide fastener guide device can have a holding surface for the rows of slide fastener coupling elements, for example slide fastener teeth. In the embodiment for my process in which the rows of slide fastener elements are also covered the invention provides that the slide fastener guide device has guide grooves which hold the rows of slide fastener elements in the swung up position in the gap in the sewing operation and the guide grooves are partially covered by the holding surface.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
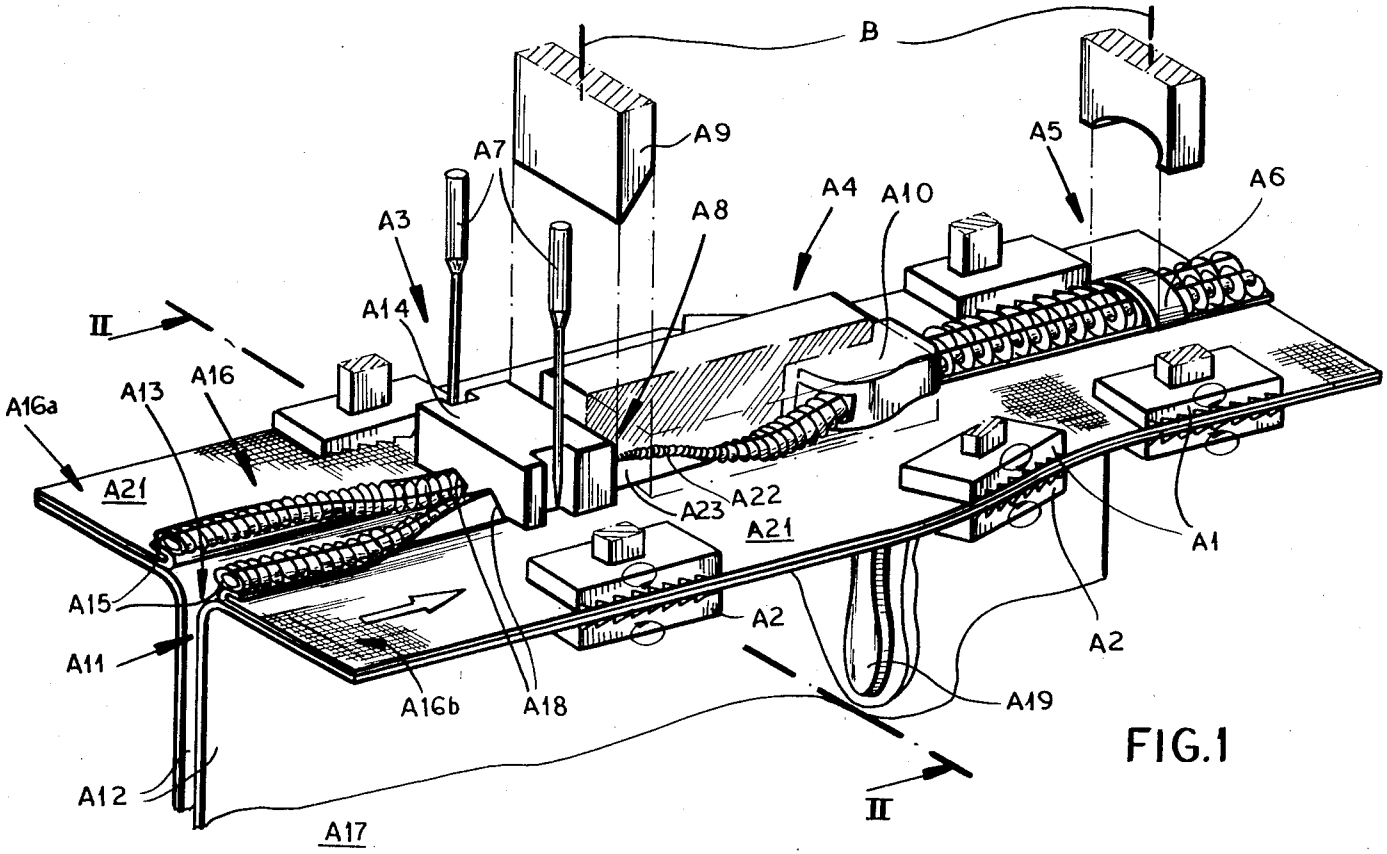
FIG. 1 is a perspective view of a portion of one embodiment of an apparatus for mounting a slide fastener near opposing edges of two pieces of material according to my invention from which one can deduce the individual steps of the corresponding process.

The apparatus shown in FIG. 1 is part of of a double needle sewing machine. This double needle sewing machine comprises a conventional upper thread sewing mechanism not shown in detail, a conventional lower thread sewing mechanism not shown in detail, and a feed mechanism A1 for the upper piece of material and a feed mechanism A2 for the lower piece of material. The feed mechanisms A1 and A2 may be the usual elliptical transport mechanisms and can include dogs or feet near the sewing station A3, however also near the slider pulling station A4 downstream of the sewing station A3, and near a subsequent mounting station A5 where the end piece A6 is put on.

Downstream in the feed direction from the sewing device A7 and upstream of the slider pulling station A4 with a snap in or snap out slide fastener slider A10 a cutting station A8 with a cutting knife A9 movable up and down is located, whereby the slide fastener slider A10 of the slider station A4 can be automatically fed in a known way. The sewing device A7 and the feed mechanisms A1 and A2 are coupled mechanically and electrically.

The lower thread sewing mechanisms are separated around an intervening space A11 so that portions of the pieces of material A12, as shown, can hang in a gap A13 of this intervening space A11.

A slide fastener guide device A14 belonging to the upper thread sewing mechanisms bridging the intervening space A11 is provided opposite to the lower thread sewing mechanisms. This guide device A14 grips the rows of slide fastener elements A15 of the neighboring open slide fastener halves A16*a* and A16*b*.

A receiving space A17 for the pieces of material A12 is positioned under the intervening space A11.

Of course the slide fastener guide device A14 can have a holding surface for the rows of slide fastener elements A15 and furthermore it can have guide grooves A18 which hold the rows of slide fastener elements A15 in the sewing operation. The guide grooves A18 can be partially covered by the gripping surface.

FIG. 1 clearly shows a process according to my invention as well as an apparatus. In my process a slide fastener B comprising slide fastener halves A16*a* and A16*b* cut from a continuously fed slide fastener strip A16 is worked in near the edges of two pieces of raterial A12 which can be assembled from several pieces or effectively endless pieces. Simultaneously a slide fastener slider A10 is pulled on the sliderless fed slide fastener strip. The pieces of material A12 are fed jointly and simultaneously to the sewing position A3 of the double needle sewing machine. After the sewing operation the sewn in slide fastener B is separated with the cutting knife A9 and the slide fastener slider A10 is pulled on with the handle A19 directed toward the upper side of the pieces of material A12.

Figure 2:
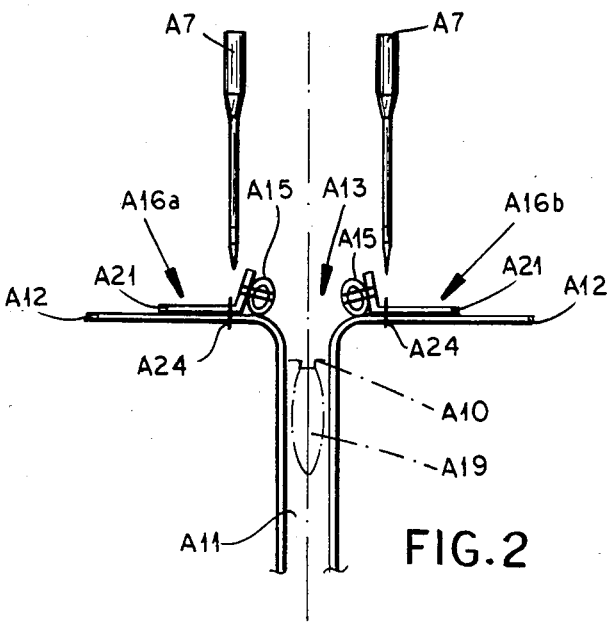
FIG. 2 is a schematic cross sectional view through the apparatus taken along the section line II—II as seen in the direction of the arrows in FIG. 1.
Figure 6:
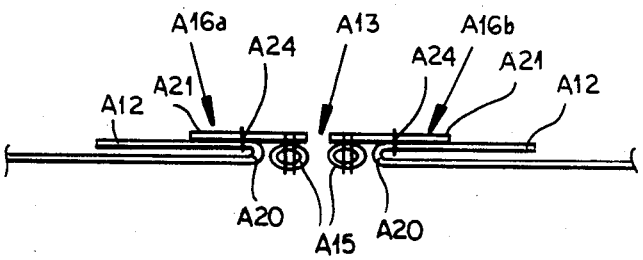
FIG. 6 is a cross sectional view of the slide fastener and pieces of material of FIG. 5 shown with the pieces of material folded into the plane of the slide fastener.

From comparison study of FIGS. 1 and 2 and 6 one sees that the pieces of material A12 form a gap A13 between both sewing stations A3, define a fold edge or crease A20, and are curved so that portions of both are hung in the intervening space A11 between both sewing stations A3 and are fed in more or less vertically.

The slide fastener strip A16 is fed to the sewing stations A3 in the open state.

The slide fastener halves A16*a* and A16*b* are sewn on with their supporting pieces A21 on the horizontal portion of the pieces of material A12 so that the handle A19 of the slide fastener slider A10 pulled on later is directed downward into the intervening space A11. After that the sewn on slide fastener halves A16*a* and A16*b* are separated by cutting the slide fastener strip 16 thus forming a leading end A23 and a trailing end A22.

The leading end A23 is fed into a slide fastener slider A10 held fixed with a handle A19 hanging downwardly so that the rows of slide fastener elements A15 are coupled together. After that the slide fastener slider is released.

Figure 3:
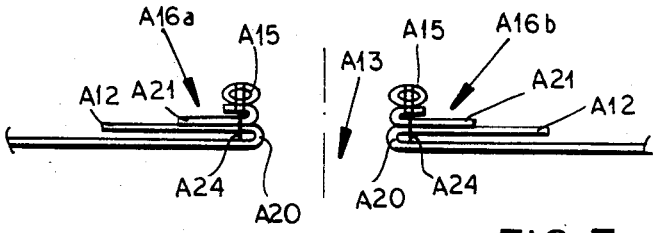
FIG. 3 is a schematic cross sectional view through the pieces of material and slide fastener according to FIG. 1 with the pieces folded back into the plane of the slide fastener.
Figure 4:
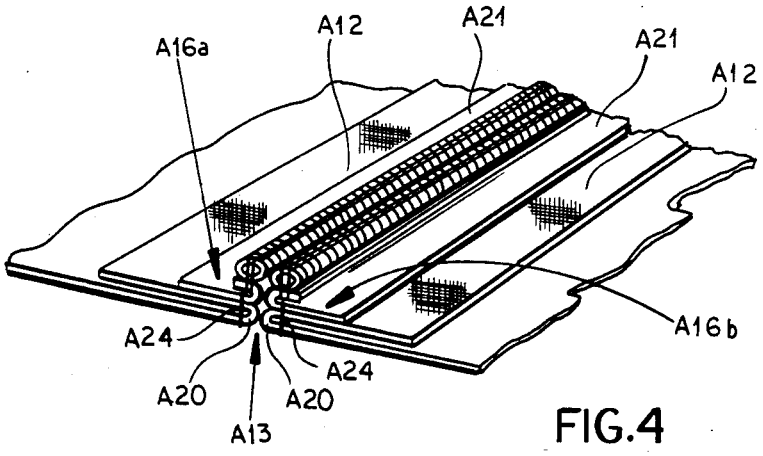
FIG. 4 is a perspective and cross sectional view of the slide fastener and pieces of material shown in FIG. 3 behind the slide fastener slider in the coupled state.

During this operation the sewing continues in the feed direction behind or upstream of the trailing end A22. Moreover the portions of the pieces of material A12 not attached with the supporting piece A21 hanging into the intervening space A11 are swung up on formation of fold edges or creases A20 into a plane parallel to the plane of the slide fastener. This can be seen from FIGS. 2 and 3 as well as FIGS. 5 and 6.

FIGS. 1 to 4 illustrate a compact, efficient and effective embodiment of a process according to my invention in which at the end of the process the rows of slide fastener elements A15 are covered by the pieces of material A12.

The slide fastener halves A16*a* and A16*b* covered with the rows of slide fastener elements A15 are fed in the slide fastener longitudinal direction along a fold edges or creases A20 near the supporting pieces A21 so that the rows of slide fastener elements A15 with the attached supporting piece portions are swung in the sewing operation into the gap A13 or the intervening space A11 and that each seam A24 is sewn near the fold edge A20 of the supporting piece A21.

Figure 5:
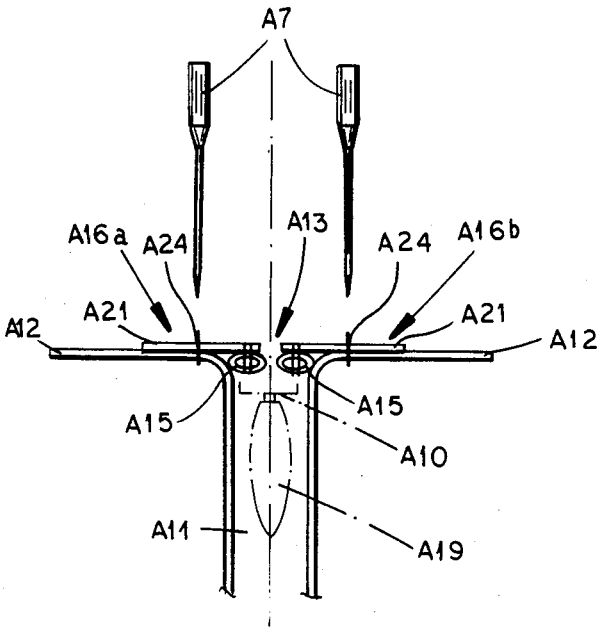
FIG. 5 is a cross sectional view of another embodiment of an apparatus for mounting a slide fastener near opposing edges of two pieces of material according to my invention similar to that of FIG. 2.

In the embodiment of FIGS. 5 and 6 the rows of slide fastener elements A15 are seen between the fold edges or creases A20 which cover the seams 24. The slide fastener halves A16*a* and A16*b* are fed as described in the open state and of course smoothly contact the pieces of material A12. After mounting these slide fastener halves all of the portions of the pieces of material hanging in the gap A13 in the sewing operation are placed substantially in a plane parallel to the slide fastener plane.

Figure 15:
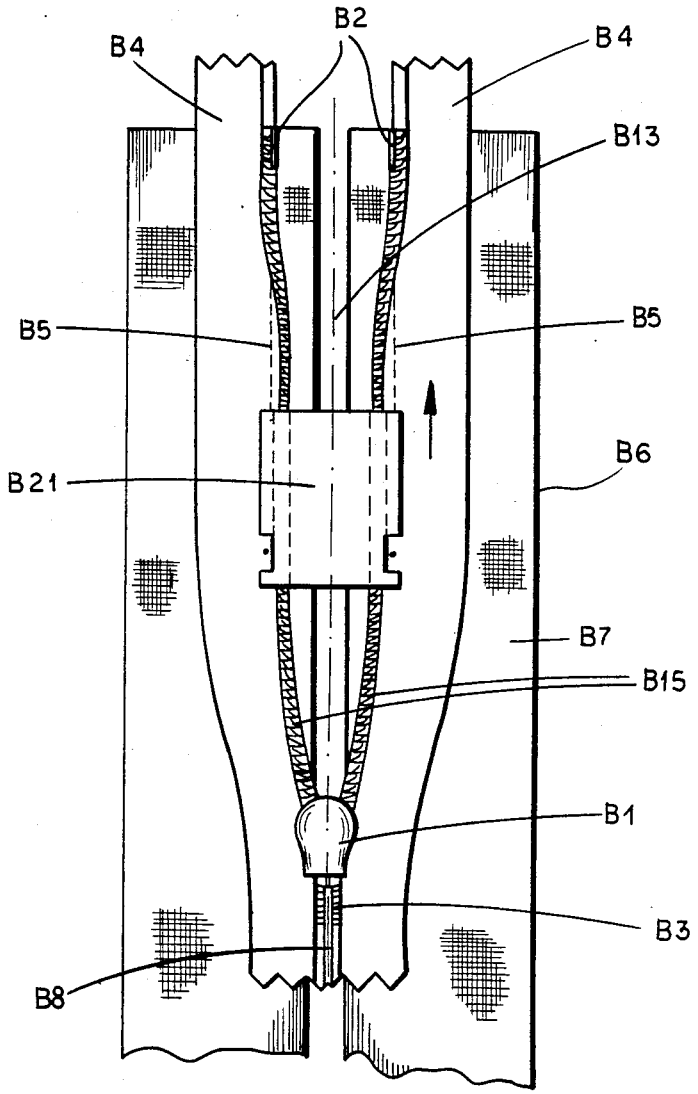
FIG. 15 is a top plan view of the mechanism shown in FIG. 14 with a slide fastener guide device with the upper portion of the sewing machine removed.

Comparison of FIGS. 7 to 9 and FIGS. 10 to 12 in connection with FIG. 15 shows that in the process according to my invention the slide fastener equipped with a slider B1, beginning piece B2 and end piece B3 having supporting pieces B4 is provided with a covered seams B5 near the opposing edges B6 of two pieces of material B7. This slide fastener is particularly sewn on a slit B8 on a piece of clothing.

The slider B1 of the slide fastener is moved first in the opening direction. Both supporting pieces B4 of the opened slide fastener strip are put on the fold edge regions B9 of the associated pieces of material B7 and the seams B5 are simultaneously sewn from the beginning piece B2 to the slider B1 of the opened slide fastener by a multineedle sewing machine B10. The seams B5 are covered by folding the pieces of material B7 to contact themselves and thus form fold edges or creases B12. The handle B11 for the slider B1 is positioned between the fold edges or creases B12.

Figure 7:
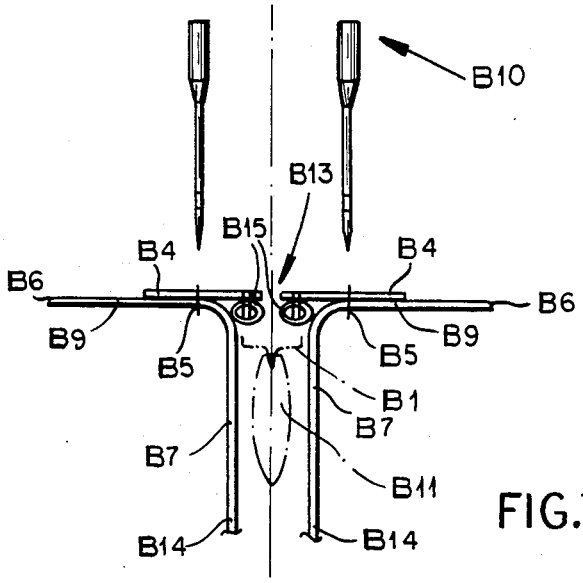
FIGS. 7 and 8 are schematic cross sectional views showing different steps of a process according to my invention for mounting a slide fastener in which opposing rows of slide fastener elements are positioned free between the pieces of material on which the slide fastener is mounted.
Figure 8:
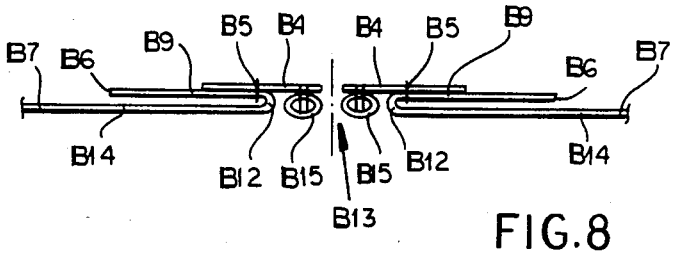

FIGS. 7 and 8 show that a portion of the pieces of material B7 in the region between the seams B5 forming a gap B13 hang more or less vertically downwardly. The slide fastener hem free with its smooth pieces B4 on the horizontal fold edge region B9 of the associated pieces of material B7 is sewn on so that the handle B11 of the slider B1 projects downwardly into the gap B13. It can lie in FIGS. 7 to 10 as is indicated by the dot-dashed lines.

The slider B1 lies in front of the gap B13 but it directed into the gap B13. After sewing on the supporting pieces B4 the portions B14 of the pieces of material B7 not attached with the supporting pieces B4 hanging into the gap B13 are folded up into a plane parallel to the slide fastener plane. That can already occur when the slide fastener is not completely mounted and occurs in the region in which the seams B5 are already formed.

Figure 9:
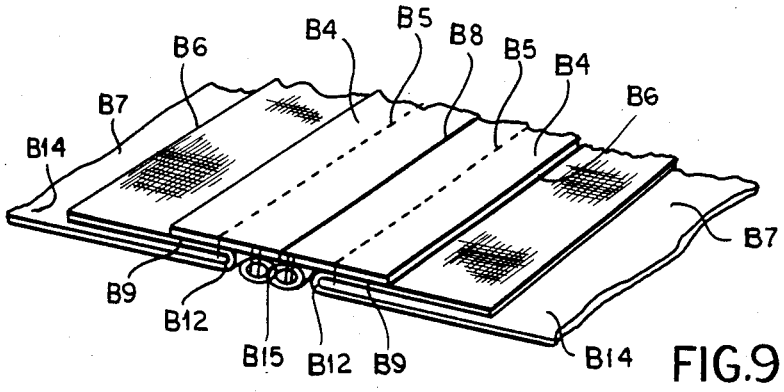
FIG. 9 is a perspective and cross sectional view of a portion of a worked in slide fastener corresponding to that of FIGS. 7 and 8 with pieces of material attached.
Figure 10:
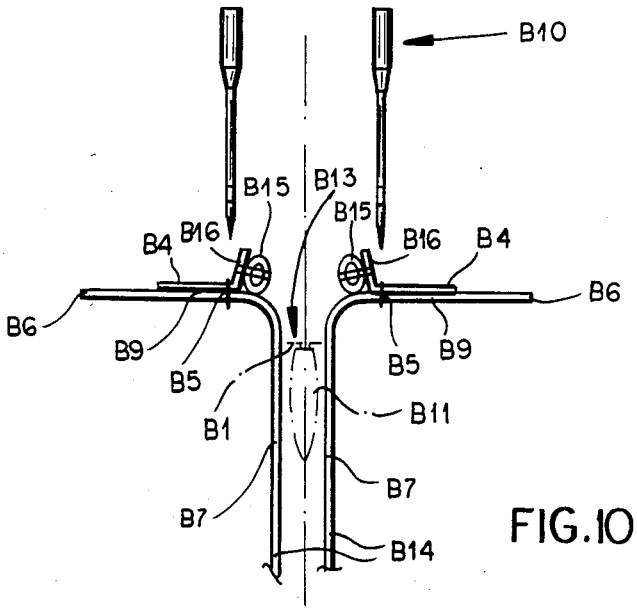
FIGS. 10 and 11 are cross sectional views showing different steps of a process according to my invention for mounting a slide fastener in which opposing rows of slide fastener elements lie covered underneath the pieces of material.
Figure 11:
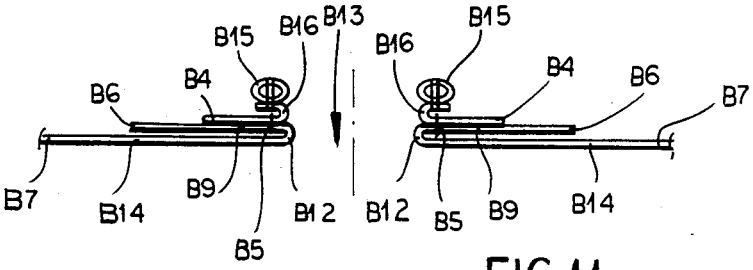
Figure 12:
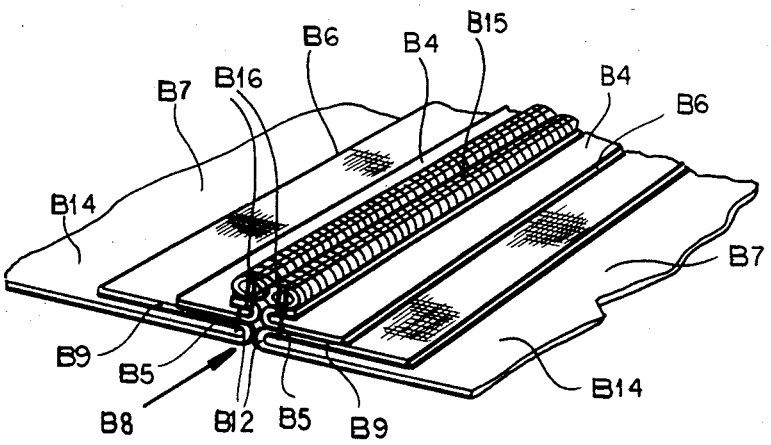
FIG. 12 is a perspective view of a portion of the worked in slide fastener corresponding to FIGS. 10 and 11 with the pieces of material attached.

FIGS. 7 to 9 shows an embodiment of my invention in which the slide fastener in a mounted state between the fold edges or creases B12 has free rows of slide fastener elements B15. In the sewing operation the portions B14 of the pieces of material B7 hanging down in the gap B13 are completely folded back into the plane parallel to the slide fastener plane. FIGS. 10 to 12 show an embodiment of the process according to my invention in which in the worked in state the rows of slide fastener elements B15 of the slide fastener are covered by the pieces of material B7. The slide fasteners are equipped with rows of slide fastener elements B15 covered by supporting pieces B4 folded along fold edges or creases B16 directed along the slide fastener longitudinal direction. The rows of slide fastener elements B15 are swung into a more or less vertical position with the attached supporting pieces B4 into the gap B13 in the sewing operation so that the seams B5 are positioned near the fold edges or creases B16 of the supporting pieces B4.

Figure 13:
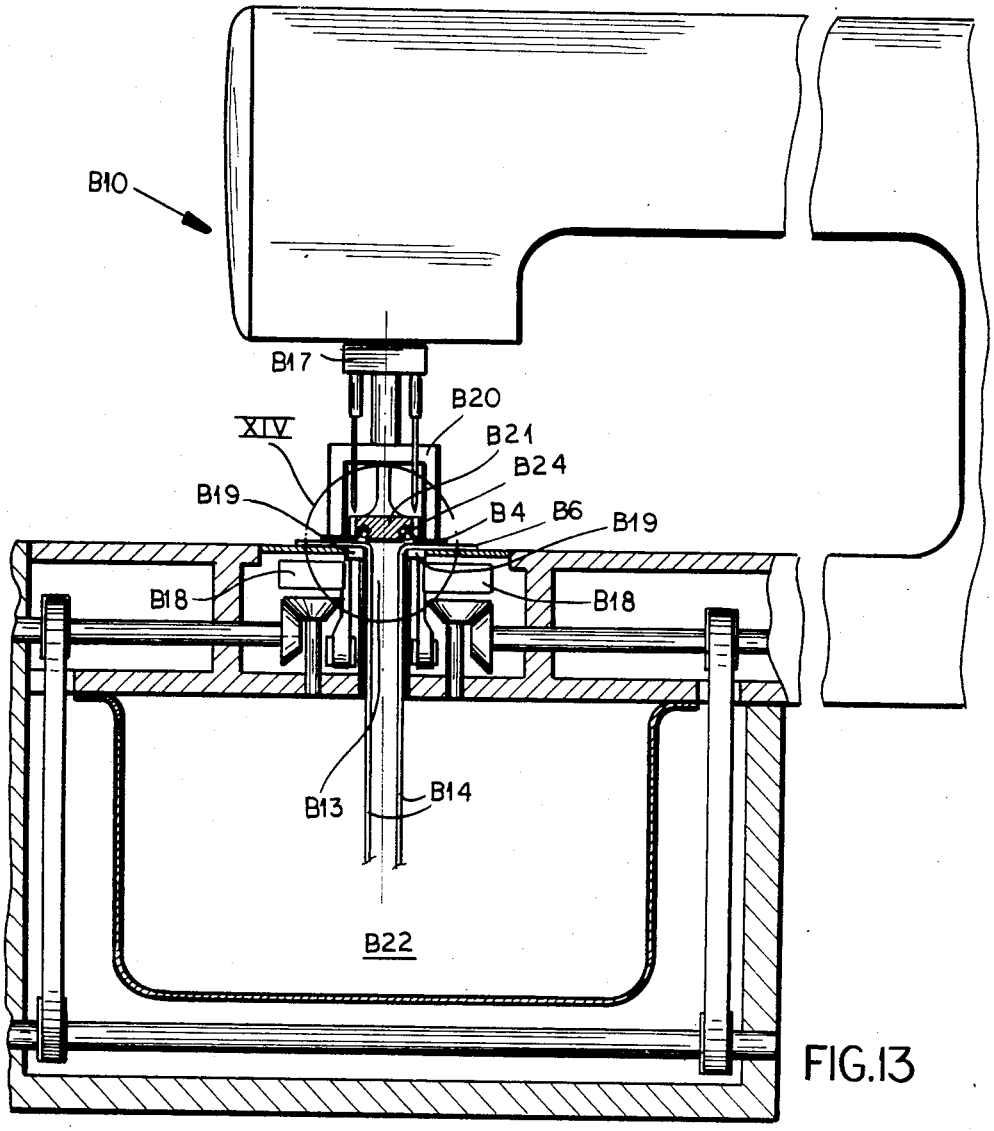
FIG. 13 is a partially side elevational and partially cross sectional view of an apparatus for performing the process as shown in FIGS. 7 to 12 in the form of a flat bed sewing machine.
Figure 14:
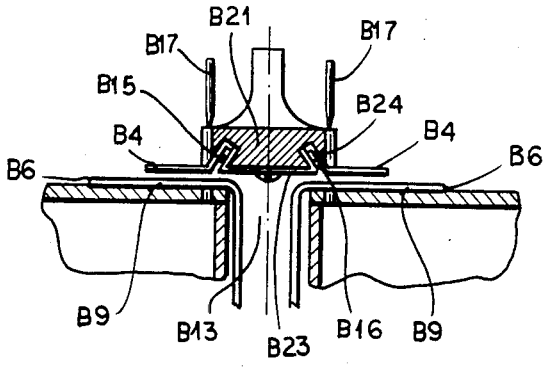
FIG. 14 is an enlarged cross sectional view of a section XIV of the apparatus of FIG. 13.
Figure 16:
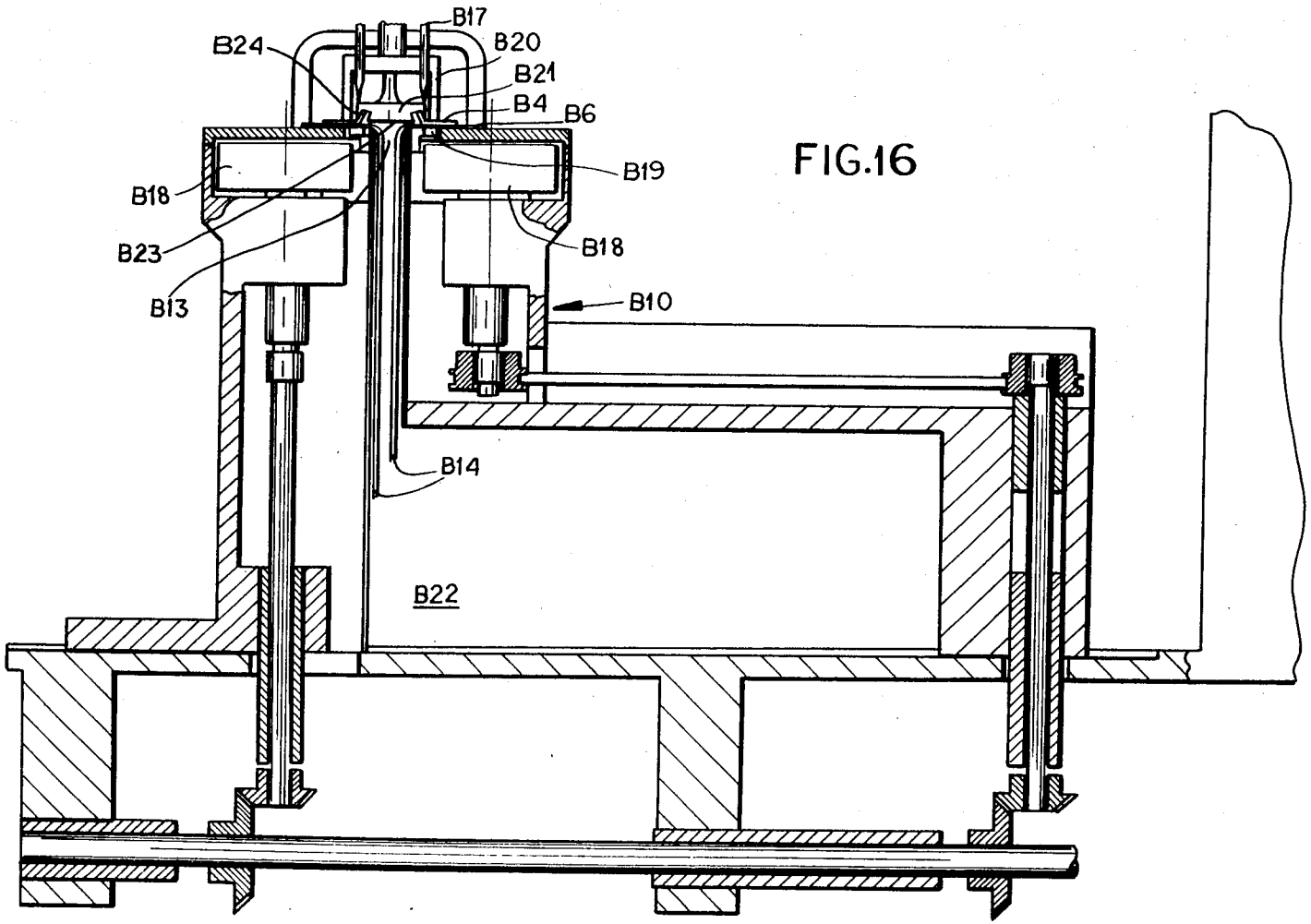
FIG. 16 is a partially cross sectional view of an apparatus for performing the process according to my invention in the form of a column sewing machine.

FIGS. 13 and 14 as well as FIG. 16 show apparatuses which perform the described process according to my invention. One of these apparatuses is shown in FIGS. 13 to 15. It basically comprises a double needle sewing machine B10 with upper thread sewing mechanisms B17, lower thread sewing mechanisms B18, a feed mechanism B19 for the pieces of material B7 and a feed mechanism B20 for the row of slide fastener elements B15.

The sewing mechanisms B17 and B18 and the feed mechanisms B19 and B20 have a drive (not shown) to which they are mechanically or electrically coupled. The lower thread sewing mechanisms B18 are separately positioned across a gap B13.

A slide fastener guide device B21 belonging to the upper thread sewing mechanisms B17 bridging the gap B13 is positioned opposing the separate lower thread sewing mechanisms B18 as is shown in FIG. 15.

The row of slide fastener elements B15 of the sewn in open slide fastener is fastened under the slide fastener guide device B21. Under the gap B13 a receiving space B22 for the pieces of material B7 is positioned, which, as described, hang downwardly between the seams B5 in this gap B13. The slide fastener guide device B21 is provided with a holding surface B23 for the row of slide fastener elements B15. FIGS. 10, 11, 12, 13, 14, 15 and 16 show embodiments of my invention in which in the worked in state the row of slide fastener elements B15 of the slide fastener are covered by the pieces of material B7. The slide fastener guide device B21 has additionally guide grooves B24 which hold the rows of slide fastener elements B15 in the swung out position in the gap B13 in the sewing operation. The sewing machine can be a flat bed sewing machine (FIGS. 13 and 14) or a column sewing machine (FIG. 16) constructed in the described way.

I claim:

1. In a process for mounting a slide fastener segment or slide fastener near the opposing edges of two pieces of material, particularly on a slit in a piece of clothing, a slide fastener strip, said slide fastener segment or said slide fastener and said pieces of material being fed to the sewing stations of a two needle sewing machine, the improvement wherein said pieces of material in the region between said sewing stations form a gap and are curved so that a portion of each hangs substantially vertically from two fold edges or creases into an intervening space between both of said sewing stations and both slide fastener halves of an open one of said slide fastener segments or an open one of said zippers are sewn on from above on said pieces of said material along said fold edges.

2. In a process according to claim 1 wherein further said slide fastener comprises two of said slide fastener halves cut from a continuously fed slide fastener strip and said slide fastener is worked in near said opposing edges of said two pieces of said material and a slide fastener slider is pulled up on a sewn in one of said zippers, said slide fastener strip without said slide fastener slider and said pieces of said material jointly and simultaneously being fed to said sewing stations of said two needle sewing machine, and after a sewing operation said sewn on slide fastener is taken and said slide fastener slider with a handle directed toward the upper side of said pieces of said material, the improvement wherein:

said pieces of said material in said region between said sewing stations define said gap and said fold edges or creases and are curved so that said portion of each hangs substantially vertically in said intervening space between said sewing stations; and said slide fastener strip in an open state being fed to said sewing stations, both slide fastener strip halves each having supporting pieces being sewn on the horizontal portion of said pieces of said material so that said handle of said slide fastener slider to be pulled up later can be directed downwardly toward said gap, after which the sewn on portion of said slide fastener strip halves being separated by cutting from said slide fastener strip while forming a trailing edge of said slide fastener separated therefrom and a leading edge of said slide fastener strip which is fed into said slide fastener slider held fixed with said handle downwardly directed and the opposing rows of slide fastener elements are coupled thereby, after which said slide fastener slider is released and during manipulation of said slide fastener said sewing operation is continued in the feed direction behind said trailing end of said slide fastener and the portion of said slide fastener strip not attached with said supporting piece hanging into said intervening space is swung around into a plane parallel to the plane of said slide fastener.

3. In a process according to claim 2 with said rows of said slide fastener elements lying free between said fold edges or creases in a sewn on state of said slide fastener, the improvement wherein said portion of said pieces of said material hanging into said gap in said sewing operation are put in said plane parallel to said plane of said slide fastener.

4. In a process according to claim 2 wherein said rows of said slide fastener elements of said slide fastener are covered by said pieces of said material in a worked in state, the improvement wherein said slide fastener strip halves with said supporting pieces folded along said fold edge in the longitudinal direction of said slide fastener covering said rows of said slide fastener elements are used, said rows of said slide fastener elements with attached portions of said supporting pieces are swung into said gap in said sewing operation and said seams are positioned near said fold edges or creases of said supporting pieces.

5. In a process according to claim 1 in which said slide fastener already having a slider, a beginning piece and an end piece as well as two rows of slide fastener elements on opposing supporting pieces is worked in by a covered seam near said opposing edges of said pieces of said material, particularly on said slit in said piece of clothing, a slider of said slide fastener being moved into an open position and both of said supporting pieces of said slide fastener in said open position are applied to said edges of said pieces of said material and said seams being made by a many needle sewing machine simultaneously from said beginning piece to said slider of said open slide fastener, further said seams are covered by folding said pieces of said material to substantially contact themselves, said handle of said slider lying between said fold edges or creases formed, the improvement wherein:

said pieces of said material lying between said seams forming said gap hang substantially vertically downwardly, said slide fastener which is fold free with smooth ones of supporting pieces is sewn on so that said handle of said slider is directed downwardly and after that the portions of said pieces of said material not attached with said supporting pieces hanging into said gap are folded substantially into a plane parallel to the plane of said slide fastener.

6. In a process according to claim 5 in which said rows of said slide fastener elements are positioned between said fold edges or creases in a worked in state, the improvement wherein all of said portions of said pieces of said material hanging into said gap in a sewing operation are placed substantially in said plane parallel to said plane of said slide fastener strip.

7. In a process according to claim 5 in which said rows of said slide fastener elements are covered by said pieces of said material in a worked in state, the improvement wherein said slide fastener with said supporting pieces folded along said fold edges or creases directed along the longitudinal direction of said slide fastener covering said slide fastener elements is used, said slide fastener elements with said connected supporting pieces are swung into said gap in a sewing operation and said seams are made near said fold edges or creases of said supporting pieces.

8. In an apparatus for mounting a slide fastener segment or a slide fastener near opposing edges of two pieces of material comprises a double needle sewing machine with upper thread sewing mechanisms, lower thread sewing mechanisms, feed mechanisms for an upper one of said pieces of said material, feed mechanisms for a lower one of said pieces of said material, said said upper and lower thread sewing mechanisms and said feed mechanisms being driven coupled electrically or mechanically, further said lower thread sewing mechanisms being separated by an intervening space between said pieces of said material, the improvement wherein a slide fastener guide device belonging to said upper thread sewing mechanisms bridging said intervening space is positioned opposite to said separated lower thread sewing mechanisms and fastens together said rows of said slide fastener elements of two open sewn in slide fastener strip halves and a receiving space for said pieces of said material is positioned under said intervening space.

9. In an apparatus for mounting a slide fastener segment or a slide fastener near opposing edges of two pieces of material comprising a two needle sewing machine having upper thread sewing mechanisms, lower thread sewing mechanisms, feed mechanisms for an upper one of said pieces of said material, feed mechanisms for a lower one of said pieces of said material, said upper and lower thread sewing mechanisms and said feed mechanisms being driven coupled mechanically or electrically, further said lower thread sewing mechanisms are separately positioned around an intervening space between a portion of said pieces of said material hanging downwardly, the improvement wherein a slide fastener guide device belonging to said upper thread sewing mechanisms bridging said intervening space is positioned opposite said separate lower thread sewing mechanisms and fastens together opposing rows of slide fastener elements of said slide fastener or said slide fastener segment which is sewn on and open and a receiving space for said pieces of said material is positioned below a gap formed between said pieces of said material.

10. The improvement according to claim 9 wherein said slide fastener guide device has a holding surface for said rows of said slide fastener elements.

11. An apparatus for mounting a slide fastener or a slide fastener segment near opposing edges of two pieces of material, particularly in a slit in a piece of clothing, comprising:

upper thread sewing mechanisms;

lower thread sewing mechanisms;

feed mechanisms for said pieces of said material, said upper and lower thread sewing mechanisms and said feed mechanisms being driven coupled mechanically or electrically;

an intervening space between a portion of said pieces of said material hanging downwardly around which said lower thread sewing mechanisms are separately positioned;

a slide fastener guide device belonging to said upper thread sewing mechanisms bridging said intervening space is positioned opposite said separate lower thread sewing mechanisms and fastens together opposing rows of slide fastener elements of said slide fastener or said slide fastener segment which is sewn on and open;

a holding surface for said rows of said slide fastener elements on said slide fastener guide device; and a receiving space for said pieces of said material is positioned below a gap formed between said pieces of said material.

12. A process for mounting a slide fastener including two slide fastener halves each having a supporting piece and a row of slide fastener elements and being cut from a continuously fed slide fastener strip near the opposing edges of two pieces of material, particularly on a slit in a piece of clothing, comprising:

feeding said slide fastener strip without said slider and said pieces of said material jointly and simultaneously to the sewing stations of a two needle sewing machine in an open state;

hanging said pieces of said material in the region between said sewing stations to form a gap so that a portion of each hangs substantially vertically from two fold edges or creases into an intervening space between both of said sewing stations;

sewing on said supporting pieces of said slide fastener strip halves each on the horizontal portion of said pieces of said material so that said handle of said slider to be pulled up later can be directed downwardly toward said gap;

after which separating the sewn on portion of said slide fastener strip halves by cutting from said slide fastener strip while forming a trailing edge of said slide fastener separated therefrom and a leading edge of said slide fastener strip which is fed into said slider held fixed with said handle downwardly directed and said rows of slide fastener elements are coupled thereby; and after which said slide fastener slider is released and during manipulation of said slide fastener said sewing operation is continued in the feed direction behind said trailing end of said slide fastener and the portion of said slide fastener strip not attached with said supporting piece hanging into said intervening space is swung around into a plane parallel to the plane of said slide fastener.

* * * * *